US010895425B2

(12) United States Patent
Nuss et al.

(10) Patent No.: US 10,895,425 B2
(45) Date of Patent: Jan. 19, 2021

(54) INTERCHANGEABLE PLATES FOR A FIREARM

(71) Applicant: Magpul Industries Corp., Austin, TX (US)

(72) Inventors: Felix Nuss, Arvada, CO (US); Yehezkel Eitan, Johnstown, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 16/454,141

(22) Filed: Jun. 27, 2019

(65) Prior Publication Data

US 2019/0316858 A1 Oct. 17, 2019

Related U.S. Application Data

(63) Continuation of application No. 16/022,246, filed on Jun. 28, 2018, now Pat. No. 10,386,138, which is a (Continued)

(51) Int. Cl.
*F41A 3/66* (2006.01)
*F41A 35/06* (2006.01)
(Continued)

(52) U.S. Cl.
CPC ..... *F41A 3/66* (2013.01); *F41A 3/22* (2013.01); *F41A 3/72* (2013.01); *F41A 35/06* (2013.01); *F41C 23/02* (2013.01); *F41C 33/007* (2013.01)

(58) Field of Classification Search
CPC .. F41A 35/06; F41A 35/00; F41A 3/64; F41A 3/66; F41A 3/72; F41C 23/00;
(Continued)

(56) References Cited

U.S. PATENT DOCUMENTS 1,913,841 A * 6/1933 Lowe ..... F41C 23/02 42/85
2,112,577 A * 3/1938 Roberts ..... F41C 23/16 42/85
(Continued)

FOREIGN PATENT DOCUMENTS

DE 19940999 A1 3/2001
DE 102004029205 B3 2/2006
(Continued)

OTHER PUBLICATIONS

Kasten, Klaus, "Extended European Search Report Regarding Application No. 18196274.7", dated Mar. 19, 2019, p. 7 Published in: EP.
(Continued)

*Primary Examiner* — Derrick R Morgan
(74) *Attorney, Agent, or Firm* — Neugeboren O'Dowd PC

(57) ABSTRACT

A firearm and related methods and components are disclosed. The firearm has a chassis, a stock portion coupled to the chassis, and a pair of interchangeable plates removably coupled to the chassis. Each of the pair of interchangeable plates is attachable to the chassis at a first location and a second location opposing the first location. A first one of the pair of interchangeable plates has a recess for receiving a portion of a bolt handle. A second one of the pair of interchangeable plates has a firearm tool interface.

20 Claims, 17 Drawing Sheets

Related U.S. Application Data continuation of application No. 15/824,161, filed on Nov. 28, 2017, now Pat. No. 10,036,602.

(51) Int. Cl.

| | |
|---|---|
| ***F41A 3/22*** | (2006.01) |
| ***F41A 3/72*** | (2006.01) |
| *F41C 23/02* | (2006.01) |
| *F41C 33/00* | (2006.01) |

(58) Field of Classification Search

CPC ..... F41C 23/02; F41C 23/16; F41C 33/007; F41C 23/20

See application file for complete search history.

(56) References Cited

U.S. PATENT DOCUMENTS 2,639,480 A * 5/1953 Magid ..... F41C 23/02 24/374
2,857,701 A * 10/1958 Morrison ..... F41C 23/16 42/85
2,873,902 A * 2/1959 Decker ..... F41C 33/007 224/257
2,933,843 A * 4/1960 McFeeter ..... F41C 23/02 42/85
3,023,527 A * 3/1962 Leek ..... F41C 23/00 42/71.01
3,061,965 A * 11/1962 Lewis ..... F41C 23/02 42/85
3,341,963 A * 9/1967 Seiderman ..... F41A 3/72 42/16
3,380,182 A 4/1968 Browning
3,791,060 A * 2/1974 Weaver ..... F41A 3/72 42/16
3,861,070 A * 1/1975 Wild ..... F41C 23/02 42/85
4,685,237 A * 8/1987 Hugg ..... F41C 23/02 224/156
5,669,169 A * 9/1997 Schmitter ..... F41A 3/66 42/75.01
5,813,158 A 9/1998 Campbell et al.
5,970,642 A 10/1999 Martin
6,487,805 B1 12/2002 Reynolds
6,490,822 B1 * 12/2002 Swan ..... F41C 23/00 42/124
6,508,025 B1 * 1/2003 Du Plessis ..... F41A 15/12 42/16
6,591,533 B2 7/2003 Wygant
6,658,781 B1 12/2003 Bowen
6,662,485 B2 12/2003 Kay
6,688,031 B2 2/2004 Steele
6,820,533 B2 11/2004 Schuerman
6,886,286 B2 5/2005 Dowding
6,889,461 B2 5/2005 Vignaroli et al.
7,048,161 B2 * 5/2006 George ..... F41C 23/02 224/150
7,325,351 B1 2/2008 Leung
7,418,797 B1 9/2008 Crose
7,428,794 B2 9/2008 Oz
7,454,858 B2 11/2008 Griffin
7,467,489 B2 12/2008 Beretta
7,506,469 B2 * 3/2009 Poulin ..... F41A 11/02 42/71.02
7,536,819 B2 5/2009 Popikow
7,552,557 B1 6/2009 Mabry
7,578,089 B1 8/2009 Griffin
D600,305 S * 9/2009 Fitzpatrick ..... D22/109
7,640,688 B2 1/2010 Oz
7,673,412 B2 3/2010 Griffin
7,698,847 B2 4/2010 Griffin
7,698,848 B1 4/2010 Bentley
7,726,060 B1 * 6/2010 Jones ..... F41A 3/66 42/75.02
7,748,154 B2 7/2010 Moretti
7,793,453 B1 9/2010 Sewell, Jr. et al.
7,802,392 B2 9/2010 Peterson et al.
7,827,719 B2 11/2010 McGarry
7,827,721 B2 11/2010 Griffin
7,841,119 B1 * 11/2010 Boyd ..... F41C 23/20 42/71.01
7,930,849 B2 4/2011 Abraham et al.
7,937,875 B1 5/2011 Berg
7,938,055 B2 5/2011 Hochstrate et al.
7,966,761 B1 6/2011 Kuczynko et al.
7,984,580 B1 7/2011 Giauque et al.
8,028,458 B2 10/2011 Rohrauer
8,056,277 B2 11/2011 Griffin
8,087,193 B2 1/2012 Kincel
8,127,483 B2 3/2012 Kincel
8,215,047 B2 7/2012 Ash, Jr. et al.
8,245,428 B2 8/2012 Griffin
D670,785 S * 11/2012 Fitzpatrick ..... D22/108
8,307,575 B1 * 11/2012 Battaglia ..... F41A 3/64 42/75.03
8,312,661 B2 11/2012 Ludlow
8,327,569 B2 12/2012 Kincel
8,387,298 B2 3/2013 Kincel
8,393,104 B1 3/2013 Moody et al.
8,429,844 B2 4/2013 Dextraze et al.
8,464,458 B2 6/2013 Chvala
8,601,734 B1 12/2013 Hopkins et al.
8,631,601 B2 1/2014 Langevin et al.
8,656,622 B2 2/2014 Peterson et al.
8,656,623 B1 2/2014 Chvala
8,720,099 B1 5/2014 Sisk
8,752,323 B2 6/2014 Fulton et al.
8,769,855 B2 7/2014 Law
8,826,797 B2 * 9/2014 Overstreet ..... F41A 35/06 89/128
8,844,185 B2 9/2014 Jarboe
8,857,094 B2 10/2014 Michel
8,904,692 B2 12/2014 Ballard
8,915,005 B2 12/2014 Grimshaw et al.
8,931,137 B2 1/2015 Daniel et al.
8,955,245 B2 2/2015 Chvala
9,010,008 B2 4/2015 Hovey
9,015,980 B2 4/2015 Shull
D729,338 S * 5/2015 Mayberry ..... D22/108
9,021,734 B2 5/2015 Voigt
D731,023 S 6/2015 Hirt et al.
9,157,696 B2 * 10/2015 Dextraze ..... F41G 11/003
9,234,722 B2 1/2016 Rice et al.
D754,808 S * 4/2016 Pittman ..... D22/108
9,341,429 B1 * 5/2016 Reavis, III ..... F41A 35/02
9,389,044 B2 7/2016 Rice et al.
9,417,033 B2 8/2016 Wood et al.
9,448,034 B2 9/2016 Downey et al.
9,464,863 B2 10/2016 Mather et al.
9,546,845 B2 1/2017 Mather
9,599,429 B1 3/2017 Davis
9,612,082 B2 4/2017 Cottle
9,612,083 B2 4/2017 Cottle et al.
9,612,084 B2 * 4/2017 Barfoot ..... F41C 23/16
9,664,479 B1 5/2017 Robinson et al.
9,927,202 B2 * 3/2018 Ives ..... F41A 3/22
10,036,602 B1 * 7/2018 Nuss ..... F41A 3/72
10,041,754 B2 * 8/2018 Tamir ..... F41A 35/02
10,222,166 B1 * 3/2019 Sheridan ..... F41A 11/00
10,228,216 B2 * 3/2019 Reeves ..... F41C 23/02
10,260,841 B2 * 4/2019 Kincel ..... F41C 23/16
10,371,482 B2 * 8/2019 Roberts ..... F41C 23/02
10,386,138 B2 8/2019 Nuss et al.
D868,924 S * 12/2019 Nuss ..... D22/108
10,612,880 B1 * 4/2020 Ding ..... F41A 35/06
2003/0029070 A1 2/2003 Dowding
2003/0051385 A1 3/2003 Wygant
2005/0235546 A1 * 10/2005 Wonisch ..... F41A 11/00 42/75.01
2005/0241211 A1 11/2005 Swan
2006/0010749 A1 1/2006 Kincel
2006/0174532 A1 8/2006 Popikow

(56) References Cited

U.S. PATENT DOCUMENTS

| | | | | |
|---|---|---|---|---|
| 2007/0006509 | A1* | 1/2007 | DeSomma | F41C 23/16 42/72 |
| 2007/0199225 | A1* | 8/2007 | Haugen | F41G 11/003 42/85 |
| 2008/0028662 | A1 | 2/2008 | Abraham et al. | |
| 2010/0037504 | A1* | 2/2010 | Muller | F41C 23/00 42/90 |
| 2010/0212201 | A1* | 8/2010 | Kincel | F41G 11/003 42/2 |
| 2011/0047850 | A1 | 3/2011 | Rievley et al. | |
| 2011/0239512 | A1* | 10/2011 | Kleven | F41C 23/02 42/85 |
| 2012/0030986 | A1* | 2/2012 | Swan | F41C 33/007 42/85 |
| 2012/0055062 | A1* | 3/2012 | Mironichev | F41G 11/003 42/85 |
| 2012/0137561 | A1 | 6/2012 | Ludlow | |
| 2012/0174451 | A1* | 7/2012 | Overstreet | F41A 35/06 42/16 |
| 2013/0091751 | A1 | 4/2013 | Barney | |
| 2013/0185895 | A1 | 7/2013 | Daniel et al. | |
| 2013/0340312 | A1 | 12/2013 | Fulton et al. | |
| 2014/0196345 | A1 | 7/2014 | Grimshaw et al. | |
| 2014/0196346 | A1 | 7/2014 | Grimshaw et al. | |
| 2014/0203053 | A1* | 7/2014 | Rivas-Schlanger | F41C 23/02 224/150 |
| 2015/0075054 | A1* | 3/2015 | Barger | F41G 11/003 42/90 |
| 2015/0176945 | A1 | 6/2015 | Simek | |
| 2015/0219422 | A1* | 8/2015 | Kincel | F41C 23/16 29/525.11 |
| 2015/0233656 | A1* | 8/2015 | Karagias | F41A 3/14 42/16 |
| 2015/0285584 | A1* | 10/2015 | Mayberry | F41G 11/003 42/71.01 |
| 2015/0292835 | A1* | 10/2015 | McCarthy | F41C 23/02 24/599.6 |
| 2016/0025120 | A1* | 1/2016 | Swan | F41G 11/003 248/231.31 |
| 2016/0025448 | A1 | 1/2016 | Kincel | |
| 2016/0033219 | A1* | 2/2016 | Meier | F41C 23/16 89/191.01 |
| 2016/0084612 | A1 | 3/2016 | Robinson et al. | |
| 2016/0116250 | A1 | 4/2016 | Mather | |
| 2016/0123698 | A1* | 5/2016 | Gellert | F41C 23/02 224/150 |
| 2016/0178309 | A1* | 6/2016 | Drake | F41A 35/06 42/14 |
| 2016/0313087 | A1* | 10/2016 | Leasure | F41C 23/16 |
| 2017/0122684 | A1* | 5/2017 | Drake | F41C 9/08 |
| 2017/0122698 | A1 | 5/2017 | Chu | |
| 2017/0191791 | A1 | 7/2017 | Davis | |
| 2017/0205192 | A1* | 7/2017 | Weimer | F41C 33/002 |
| 2017/0299297 | A1* | 10/2017 | Scalf | F41A 11/02 |
| 2018/0066905 | A1* | 3/2018 | Battaglia | F41A 11/02 |
| 2018/0112952 | A1* | 4/2018 | Kincel | F41C 27/00 |
| 2018/0120053 | A1* | 5/2018 | Kolb | F41C 23/02 |
| 2019/0078853 | A1* | 3/2019 | Johnson, Sr. | F41A 23/005 |
| 2019/0086168 | A1* | 3/2019 | Song | F41A 3/66 |
| 2019/0101345 | A1* | 4/2019 | Fellows | F41A 3/66 |
| 2019/0113306 | A1* | 4/2019 | Kincel | F41C 23/16 |
| 2019/0162494 | A1* | 5/2019 | Nuss | F41A 3/72 |
| 2019/0178608 | A1* | 6/2019 | Drake | F41C 27/00 |
| 2019/0212083 | A1* | 7/2019 | Konev | F41A 17/38 |
| 2020/0011636 | A1* | 1/2020 | Jen | F41C 27/00 |

FOREIGN PATENT DOCUMENTS

| | | | |
|---|---|---|---|
| DE | 102006047959 | B3 | 6/2008 |
| EP | 890816 | A2 | 1/1999 |
| EP | 1026472 | A2 | 8/2000 |
| EP | 1026472 | A3 | 4/2001 |
| EP | 1674816 | A1 | 6/2006 |
| EP | 1688696 | A1 | 8/2006 |
| EP | 1756508 | A1 | 2/2007 |
| EP | 1975541 | A2 | 10/2008 |
| EP | 2198235 | A1 | 6/2010 |
| EP | 2541188 | A1 | 1/2013 |
| EP | 3163248 | A1 | 5/2017 |
| GB | 754040 | A | 8/1956 |
| GB | 2332039 | A | 6/1999 |
| GB | 2346203 | A | 8/2000 |
| GB | 2382123 | A | 5/2003 |
| JP | 11118392 | A | 4/1999 |
| RU | 2077016 | C1 | 4/1997 |
| RU | 2329450 | C2 | 1/2006 |
| RU | 2543139 | C1 | 2/2015 |
| WO | 2015034410 | A1 | 3/2015 |
| WO | 2015066590 | A2 | 5/2015 |

OTHER PUBLICATIONS

Accuracy International, "AICS Chassis Systems", "Retrieved from http://www.accuracyinternational.us/aics-chassis-systems/", Known to exist as early as May 15, 2017, p. 4.

Accuracy International, "Accuracy International at Rifle System", "Retrieved from http://www.accuracyinternational.us/at-rifle-system/", Known to exist as early as May 15, 2017, p. 4.

Accuracy International, "AX Rifle Systems", "Retrieved from http://www.accuracyinternational.us/ax-rifle-systems/", Known to exist as early as May 15, 2017, p. 4.

Athlon Outdoors, "Accurate—MAGS AM40A6 .308 Delivers Sub-MOA Precision", Feb. 18, 2016, Publisher: Retrieved from https://www.tactical-life.com/firearms/accurate-mags-am40a6-308-delivers-sub-moa-precision/#accurate-mag-am40a6-trigger, p. 12.

Monveldt, Sergey, "File History Re U.S. Appl. No. 14/284,376", Aug. 20, 2015, p. 48.

Armlist, LLC, "Mcrees Precision G5 R7ST Chassis", "Retrieved from http://www.armslist.com/posts/5191383/wyoming-gun-parts-for-sale-mcrees-precision-g5-r7st-chassis", Known to exist as early as May 15, 2017, p. 1.

Eberlestock, "Stealth Rifle Chassis", "Retrieved from http://www.eberlestock.com/store/stealth-rifle-chassis", Feb. 8, 2016, p. 2.

J. Allen Enterprises, "JAE-700 Standard Colors / Pricing", "Retrieved from http://www.jallenglobal.com/rife-stocks/jae-700/jae-700-standard-orders/", Known to exist as early as May 15, 2017, p. 4.

Kinetic Research Group, LLC, "KRG Whiskey-3 Chassis", "Retrieved from https://kineticresearchgroup.com/product/whiskey-3-chassis/", Known to exist as early as May 15, 2017, p. 9.

Coker Tactical, LLC, "KRG Whiskey 3 Chassis Stock Review", "Retrieved from https://tacticalgunreview.com/krg-whiskey-3-chassis-stock-review/", Apr. 7, 2014, p. 3.

Kinetic Research Group, LLC, "KRG X-Ray Chassis", "Retrieved from https://kineticresearchgroup.com/product/x-ray-chassis/", Known to exist as early as May 15, 2017, p. 7.

McRees Precision, "McRee's Precision G7 Rifle Stock Series", "Retrieved from http://shop.mcreesprecision.net/G7-RIFLE-STOCKS_c478.htm", Known to exist as early as May 15, 2017, p. 2.

McRee's Precision, "McRee's Precision G10 Rifle Stock Series", "Retrieved from http://shop.mcreesprecision.net/G10-RIFLE-STOCKS_c490.htm", Known to exist as early as May 15, 2017, p. 2.

Clement, Michelle Renee, "Prosecution History Re U.S. Appl. No. 12/541,806", Sep. 17, 2010, p. 73.

Recoil Magazine, "Preview Mcree G5 TMAG", "Retrieved from http://www.recoilweb.com/preview-mcree-g5-tmag-1000-yards-no-problem-29765.html", Known to exist as early as May 15, 2017, p. 3.

Remington Arms Company, Inc., "Sniper Rifles MSR", "Retrieved from http://remingtonmilitary.com/Firearms/Sniper%20Rifles/MSR.aspx", Known to exist as early as May 15, 2017, p. 2.

Sako, Ltd., "Sako TRG", "Retrieved from http://www.sako.fi/rifles/sako-trg#rifles", Known to exist as early as May 15, 2017, p. 8.

Soldier Systems, "Posts Tagged Sig Sauer", "Retrieved from http://soldiersystems.net/tag/sig-sauer/page/5/", Feb. 18, 2016, p. 23.

(56) References Cited

OTHER PUBLICATIONS

XLR Industries, "Evolution Chassis Package", "Retrieved from https://xlrindustries.com/collections/chassis/products/evolution-chassis", Known to exist as early as May 15, 2017, p. 2.

* cited by examiner

INTERCHANGEABLE PLATES FOR A FIREARM

CLAIM OF PRIORITY UNDER 35 U.S.C. § 120

The present application for patent is a Continuation of patent application Ser. No. 16/022,246 entitled "INTERCHANGEABLE PLATES FOR A FIREARM" filed Jun. 28, 2018, pending, which is a Continuation of patent application Ser. No. 15/824,161 entitled "INTERCHANGABLE PLATES FOR A FIREARM" filed Nov. 28, 2017 and issued as U.S. Pat. No. 10,036,602 on Jul. 31, 2018, each assigned to the assignee hereof and hereby expressly incorporated by reference herein.

BACKGROUND

Field

The present invention relates generally to firearms, and more specifically to accommodations for a bolt handle.

Background

In the course of manufacturing firearm, historically, manufacturers have generally provided firearms and components suited for right-handed users. Left-handed users are generally required to special order firearms or components suitable for use. However, as much as 10% of the population is left-handed, meaning that a substantial portion of the population whose needs are only met through special-order components. Moreover, users, particularly those in the after-market components industry, desire that firearms have as much versatility and usability as possible. There is therefore a need for a firearm that increases versatility and provides greater access to left-handed users.

SUMMARY

An exemplary firearm has a chassis, a stock portion coupled to the chassis, and a pair of interchangeable plates removably coupled to the chassis. Each of the exemplary pair of interchangeable plates is attachable to the chassis at a first location and a second location opposing the first location. A first one of the exemplary pair of interchangeable plates has a recess for receiving a portion of a bolt handle. A second one of the exemplary pair of interchangeable plates has a firearm tool interface.

An exemplary method includes providing a firearm having a bolt handle, a chassis, and a stock portion coupled to the chassis. The exemplary method includes providing a pair of reversible plates, wherein a first one of the pair of reversible plates has a recess for receiving a portion of the bolt handle, and a second one of the pair of reversible plates has a firearm tool interface. The exemplary method includes removably coupling the first one of the pair of reversible plates to the chassis at a first location, and removably coupling the second one of the pair reversible plates to the chassis at a second location opposing the first location.

DETAILED DESCRIPTION

The word "exemplary" is used herein to mean "serving as an example, instance, or illustration." Any embodiment described herein as "exemplary" is not necessarily to be construed as preferred or advantageous over other embodiments. For the purpose of this document, the term "distal" shall refer to a direction or side associated with a firing direction of a firearm. The term "proximal" shall refer to a direction or side associated with a side or direction opposing the firing direction or distal side.

Figure 1:
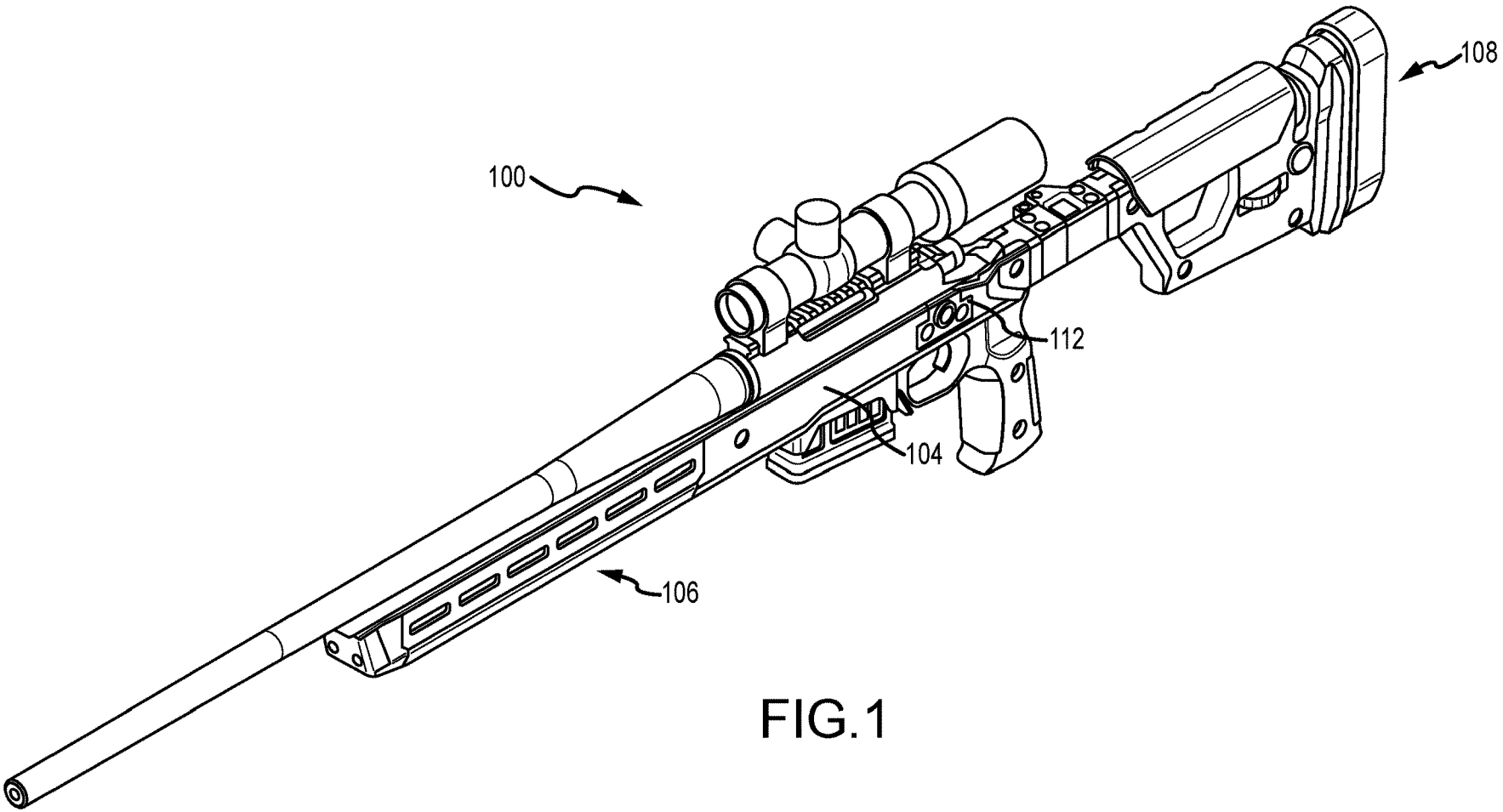
FIG. 1 is a perspective view of a firearm.
Figure 2:
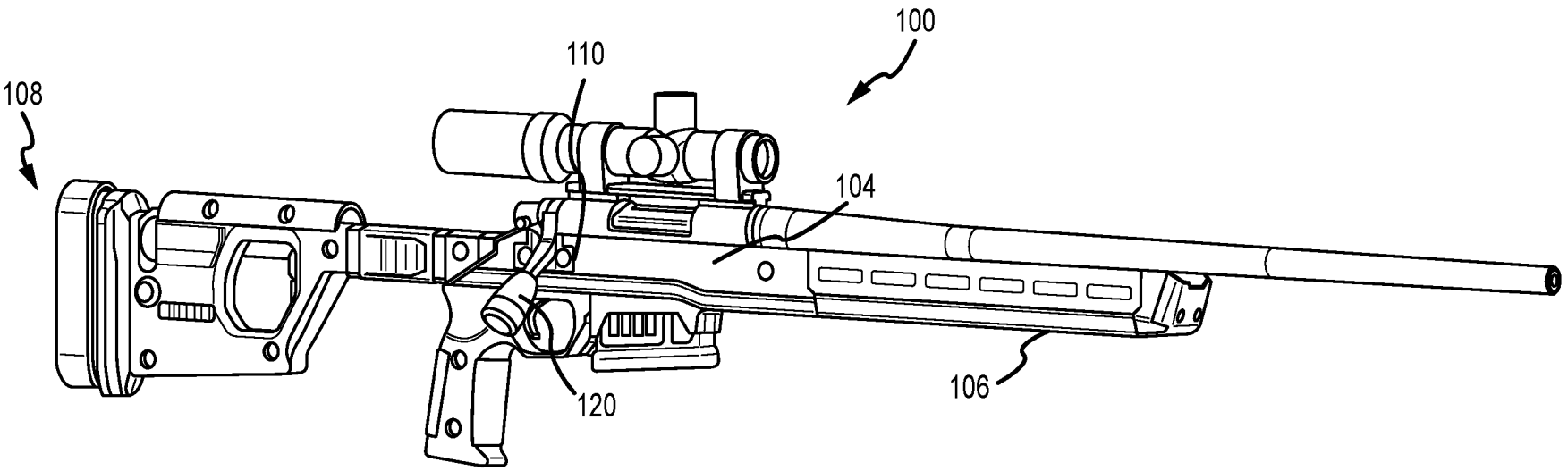
FIG. 2 is a second perspective view of the firearm in FIG. 1.
Figure 3:
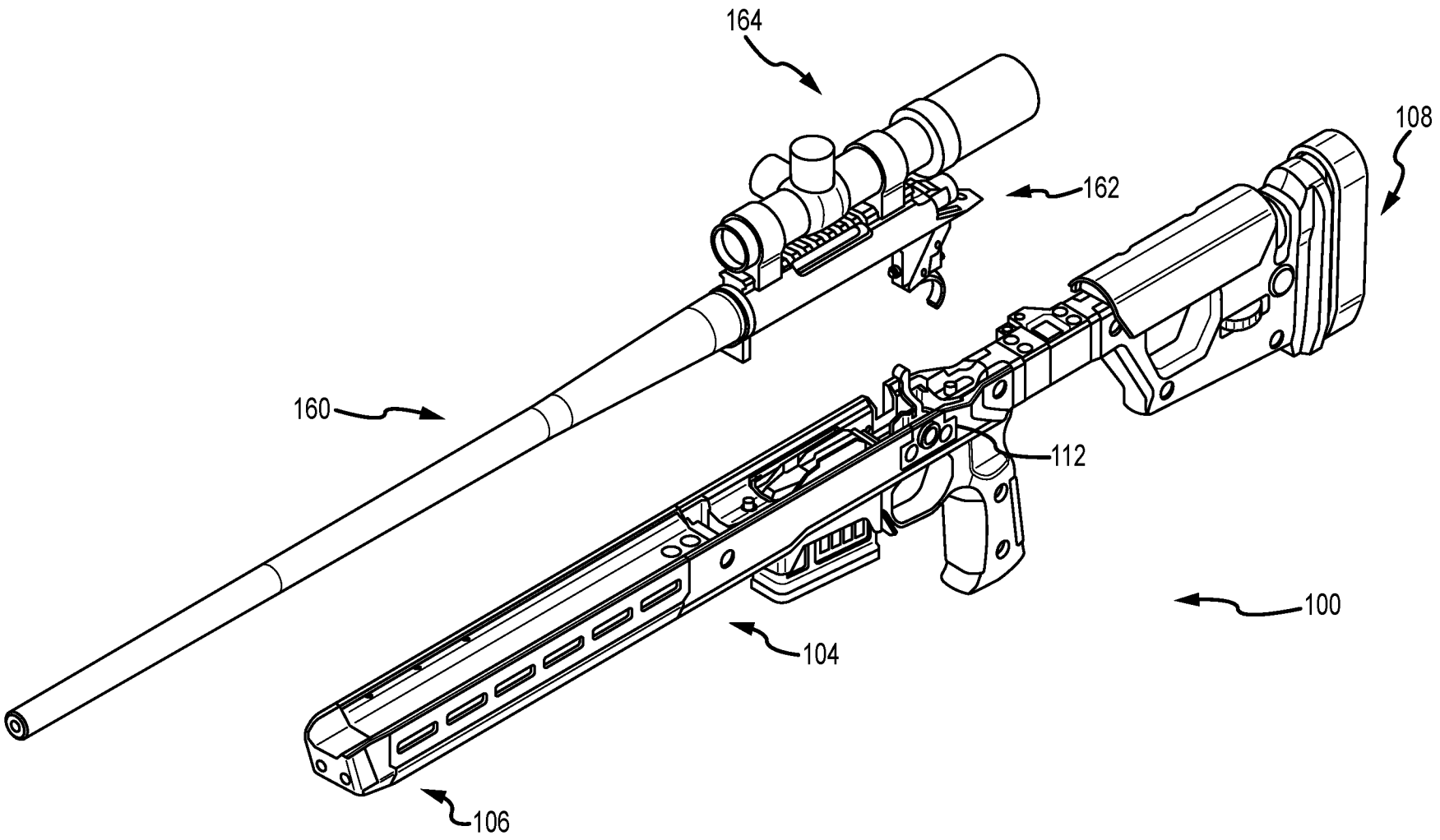
FIG. 3 is a partial exploded perspective view of the firearm in FIG. 1 with components.

As previously indicated, current firearms are generally provided by the manufacturer as either being left-handed or right-handed. However, those in the after-market components industry seek greater versatility in both the ability to meet the needs for left- and right-handed users, as well as to provide a firearm that has increased user features. The Applicant meets these needs by providing a firearm 100 with a pair of reversible plates 100, 112, to accommodate either a right-handed bolt 120 as illustrated in FIG. 1 or a left-handed bolt (not illustrated). Additionally, one of the plates 112 is provided with a tool interface 122. Where the tool interface 122 includes a QD socket 122, the user is provided with the ability to carry the firearm 100 at a point that is near—but proximal of—the center of gravity of the firearm, thus ensuring the firearm 100 is pointed downward during transport but high enough that the firearm 100 is maintained at an ideal carrying height. That is, the location of the plates 100, 112 provides a dual function.

With reference now to FIGS. 1-4, an exemplary firearm 100 is described. The firearm 100 may have a chassis 102 (see e.g. FIG. 4) and a stock portion 104 coupled to or configured to be coupled to the chassis 102. The stock portion 104 may have a forend 106 associated with a distal portion of the firearm 100, and/or a buttstock portion 108 associated with a proximal end of the firearm 100. A pair of reversible plates 110, 112 may be removably coupled to the chassis 102, each of the pair of reversible plates 110, 112 attachable to the chassis 102 at a first location 114 and a second location 116 opposing the first location 114. The locations 114, 116 may be proximal of a center of gravity of the firearm 100. As most clearly illustrated in FIG. 3, the firearm 100 may include a barrel 160, a receiver portion 162, and/or a scope 164 or other tool.

Figure 6:
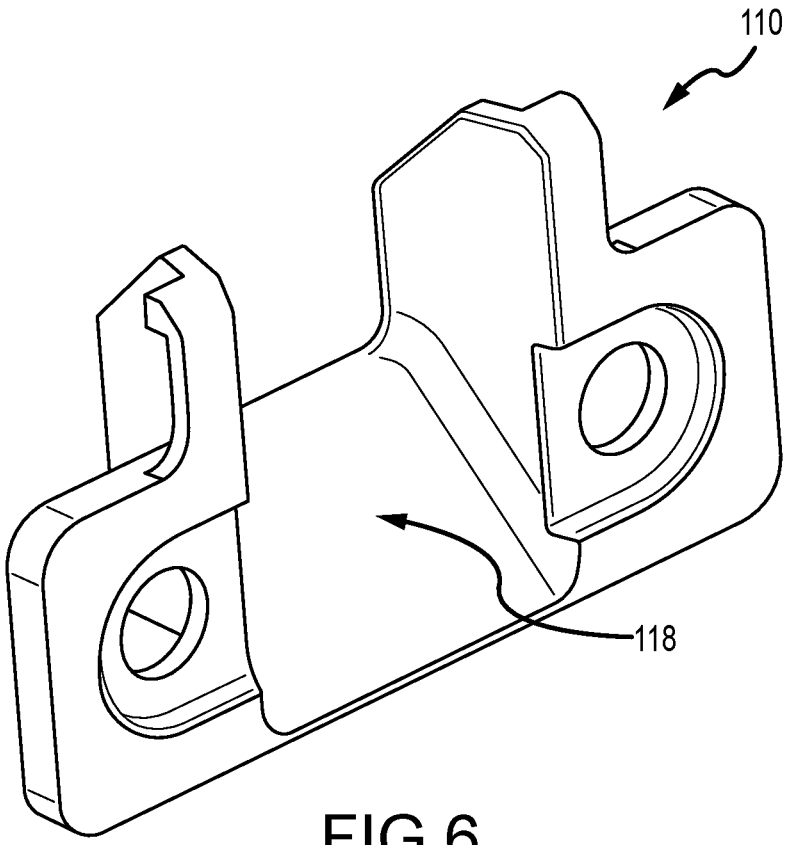
FIG. 6 is a perspective view of a first plate used in the firearm in FIG. 1.
Figure 7:
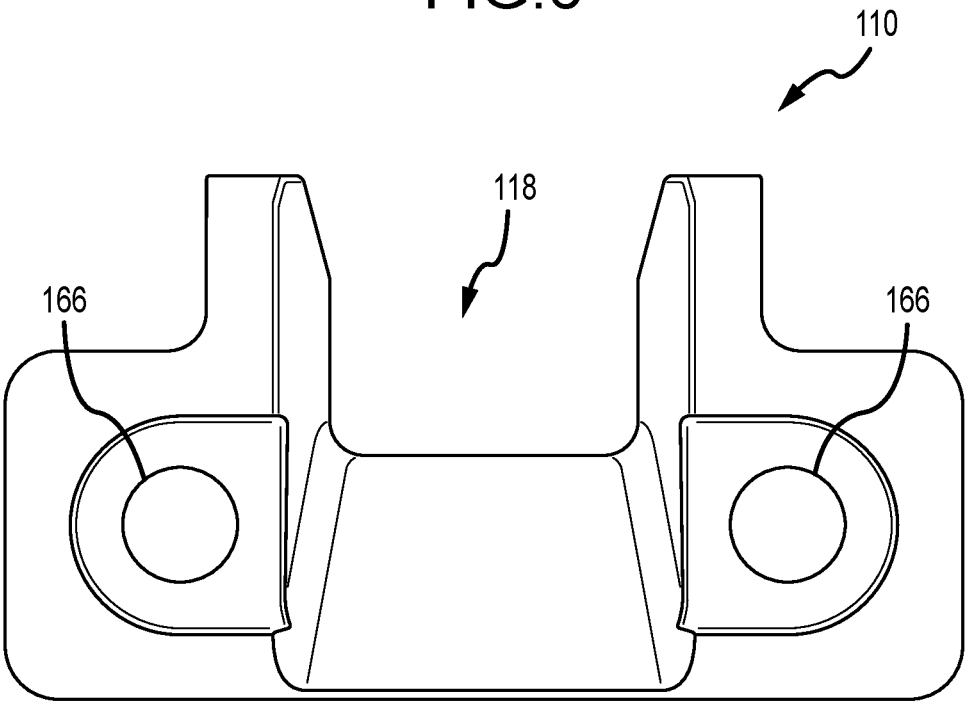
FIG. 7 is a front view of the plate in FIG. 6.
Figure 8:
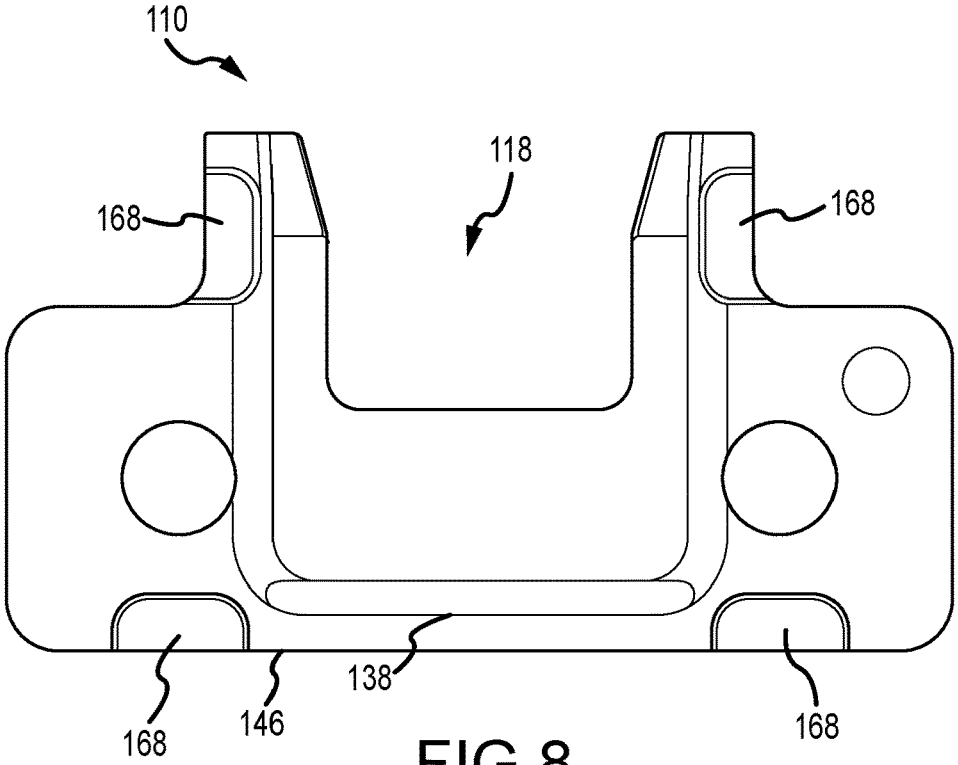
FIG. 8 is a rear view of the plate in FIG. 6.
Figure 9:
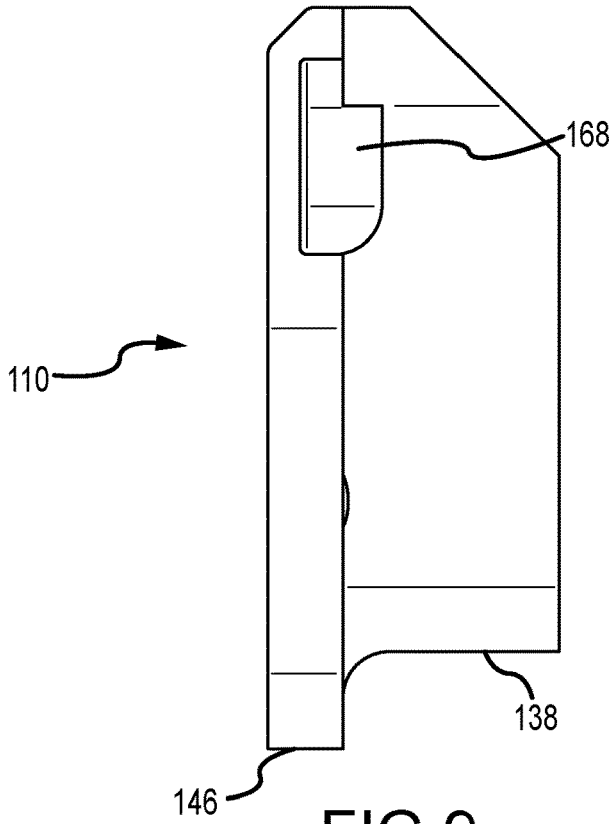
FIG. 9 is a right side view of the plate in FIG. 6.
Figure 10:
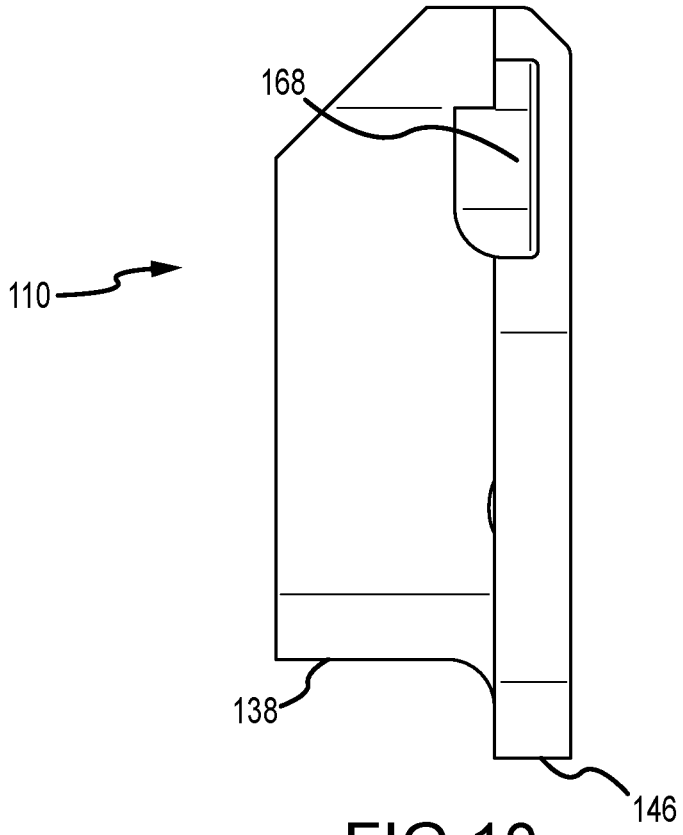
FIG. 10 is a left side view of the plate in FIG. 6.
Figure 11:
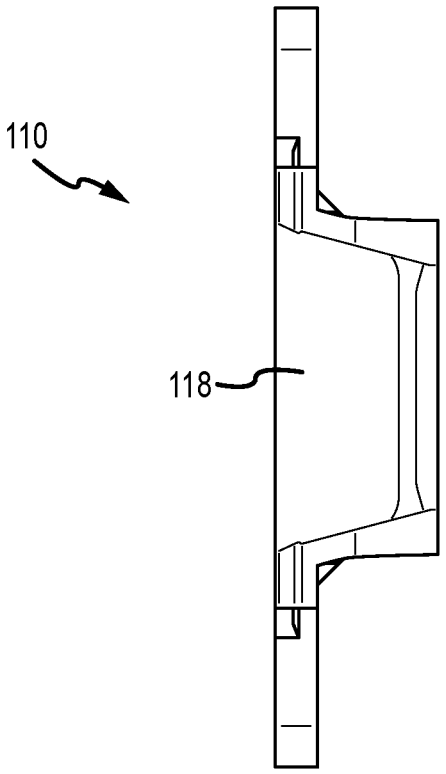
FIG. 11 is a top view of the plate in FIG. 6.
Figure 12:
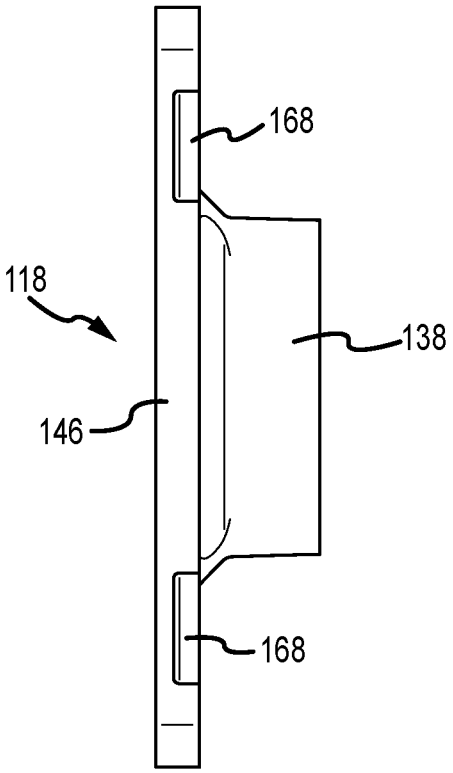
FIG. 12 is a bottom view of the plate in FIG. 6.
Figure 13:
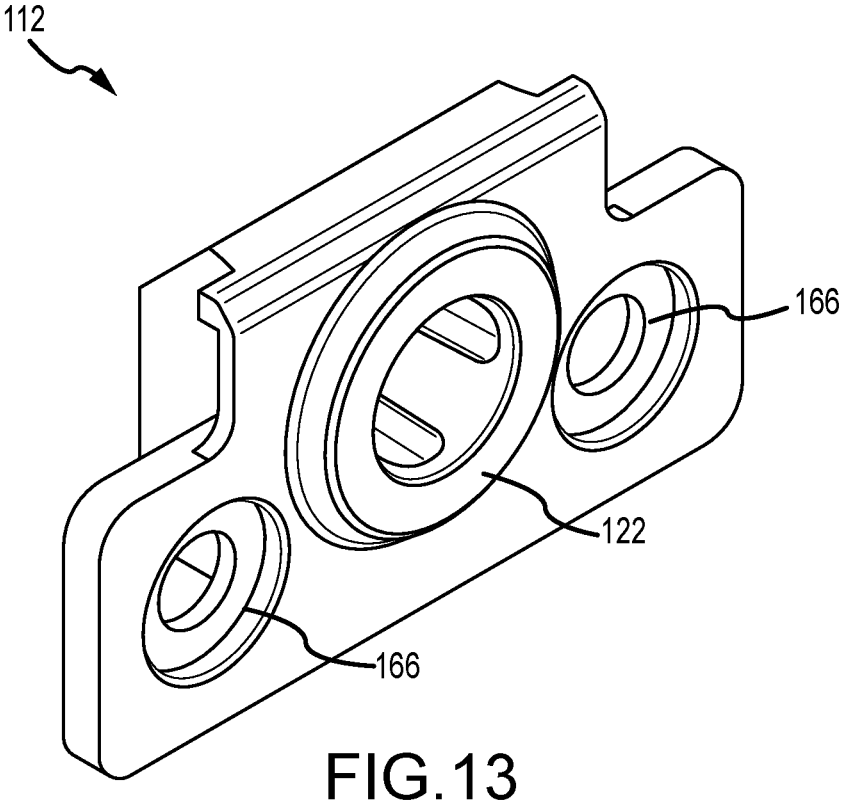
FIG. 13 is a perspective view of a second plate used in the firearm in FIG. 1.
Figure 14:
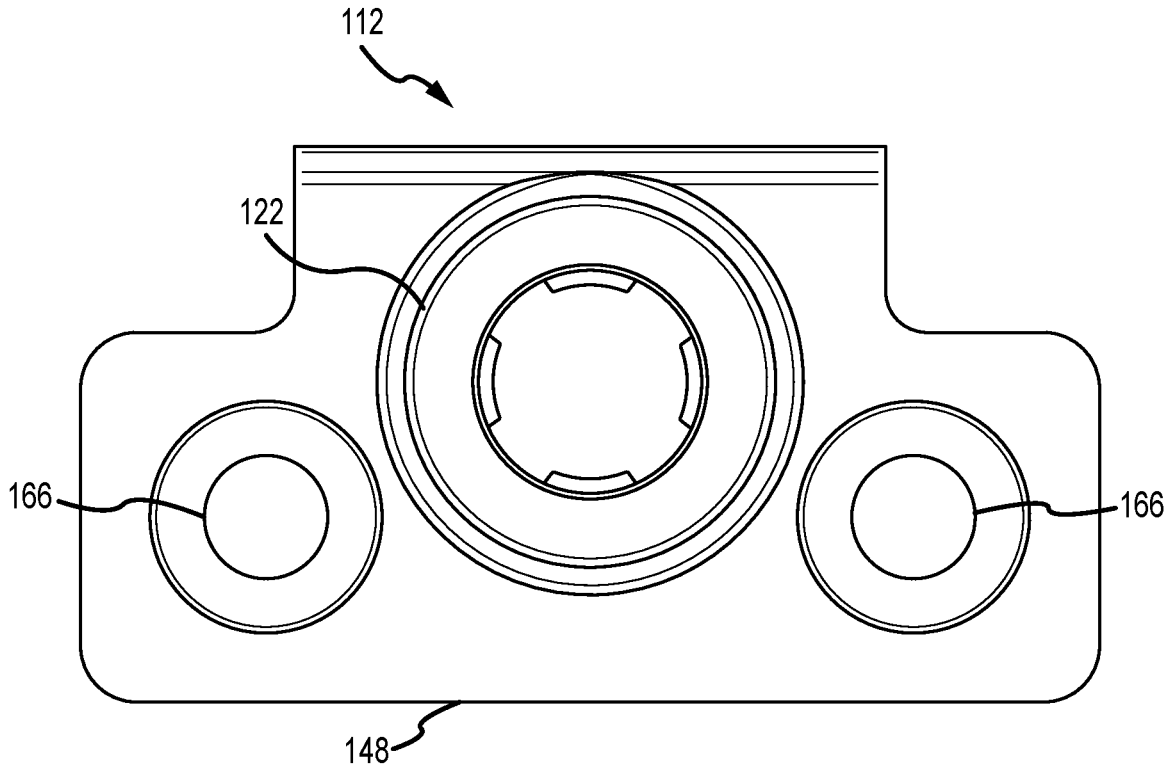
FIG. 14 is a front view of the plate in FIG. 13.
Figure 15:
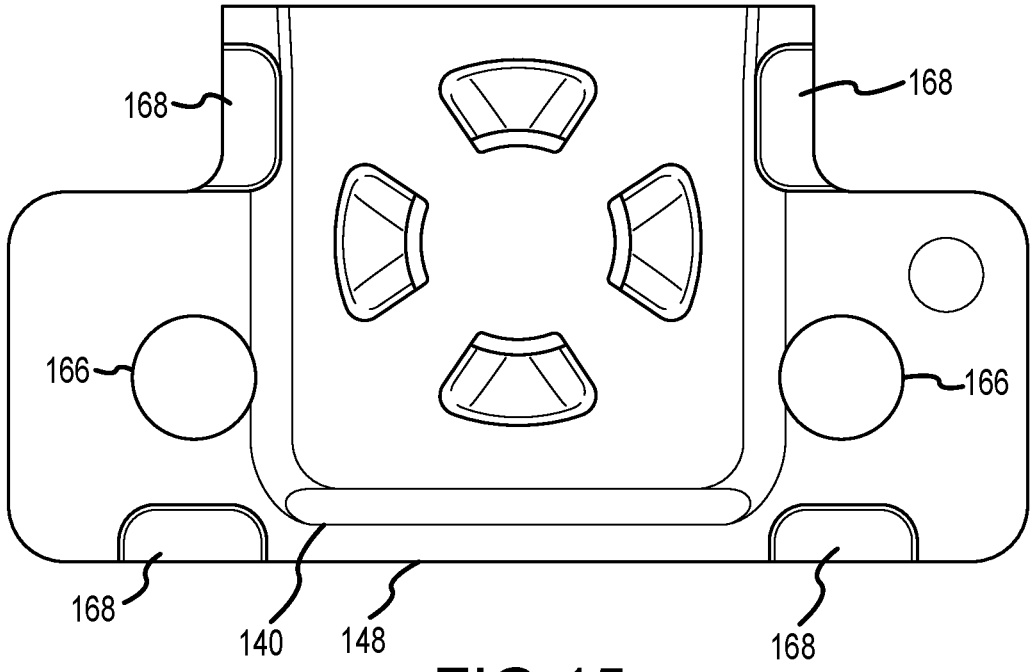
FIG. 15 is a rear view of the plate in FIG. 13.
Figure 16:
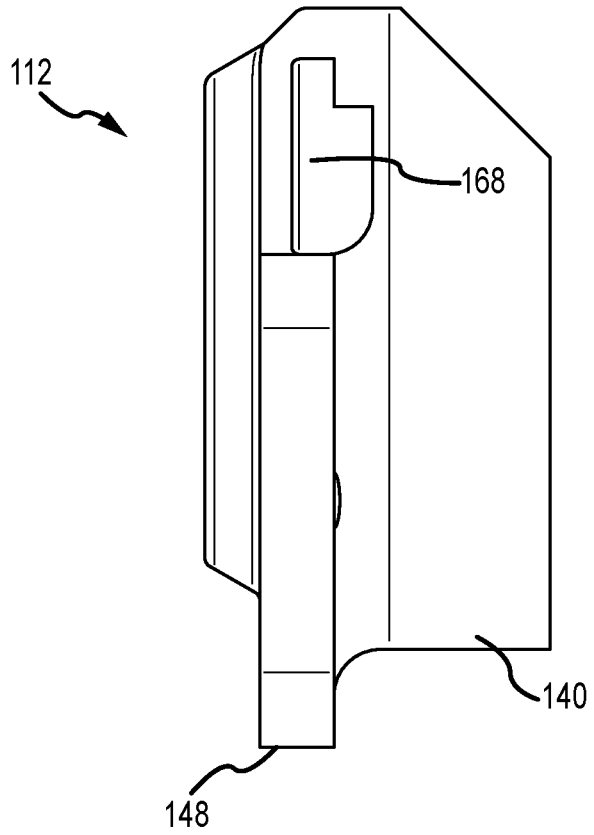
FIG. 16 is a right side view of the plate in FIG. 13.
Figure 17:
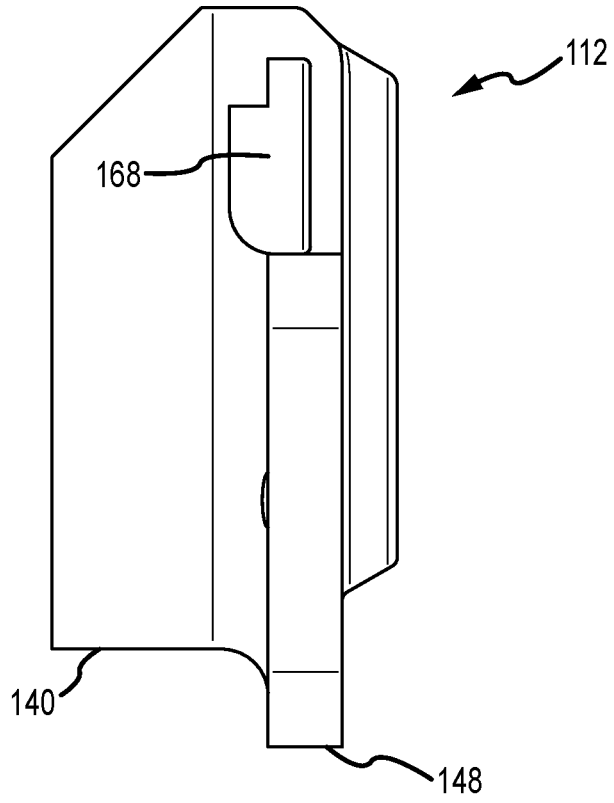
FIG. 17 is a left side view of the plate in FIG. 13.
Figure 18:
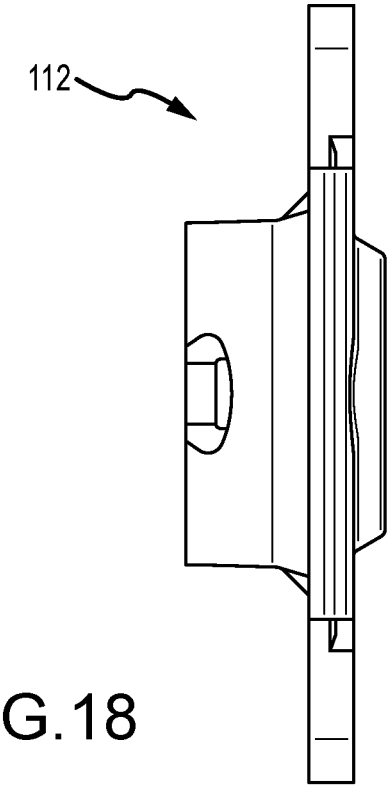
FIG. 18 is a top view of the plate in FIG. 13.
Figure 19:
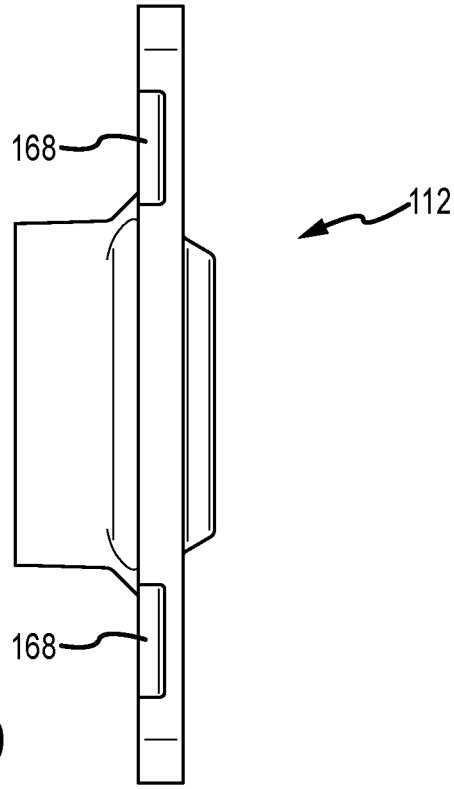
FIG. 19 is a bottom view of the plate in FIG. 13.

A first one of the pair of reversible plates 110 may have a recess 118 for receiving a portion of a bolt handle 120 (see e.g. FIG. 1 and FIG. 6). A second one of the pair of reversible plates 112 may have a firearm tool interface 122, as most clearly illustrated in FIG. 13. The firearm tool interface 122 may be a quick-disconnect (QD) socket 122.

Figure 4:
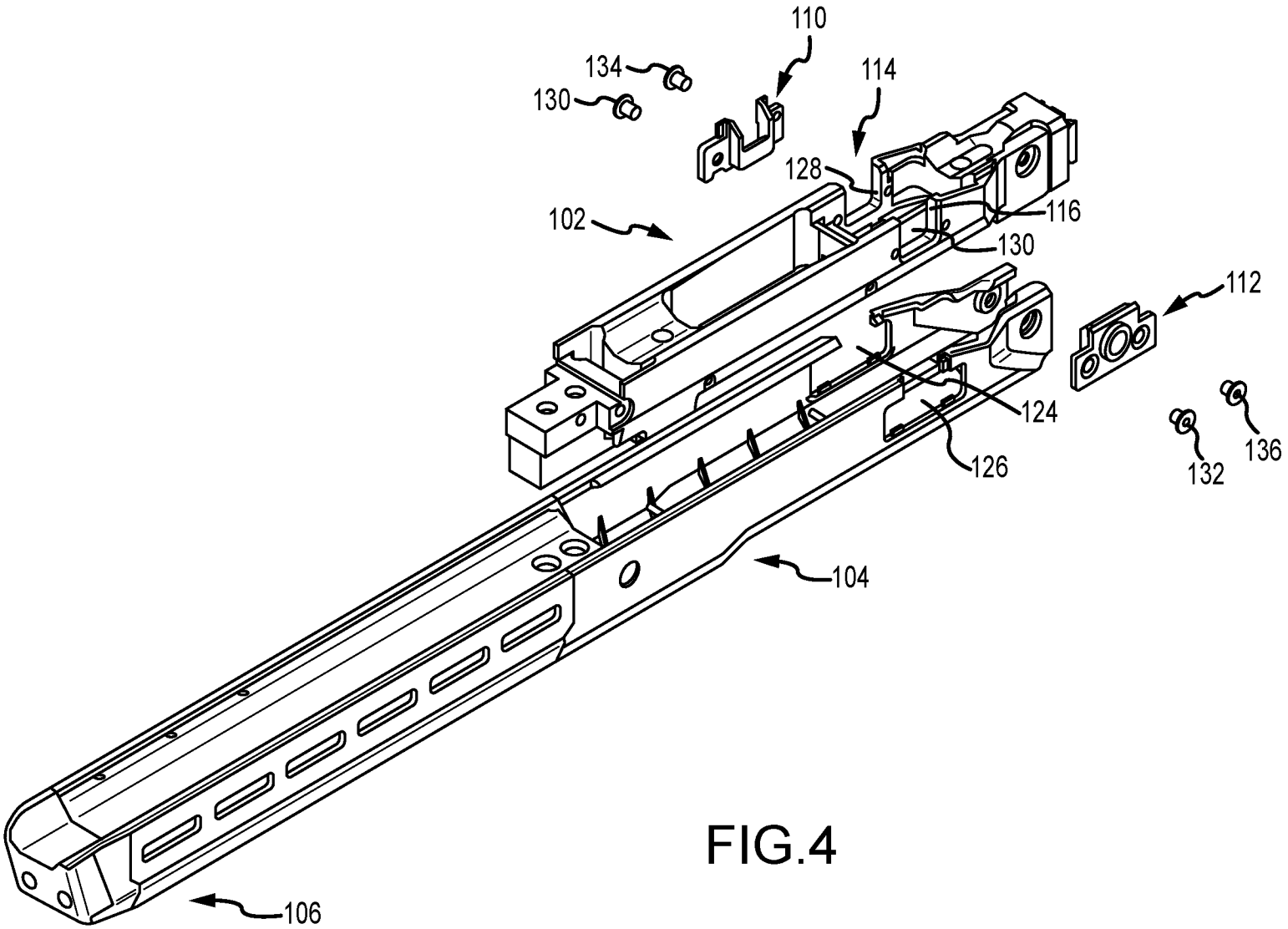
FIG. 4 is a perspective view of some components of the firearm in FIG. 1.
Figure 5:
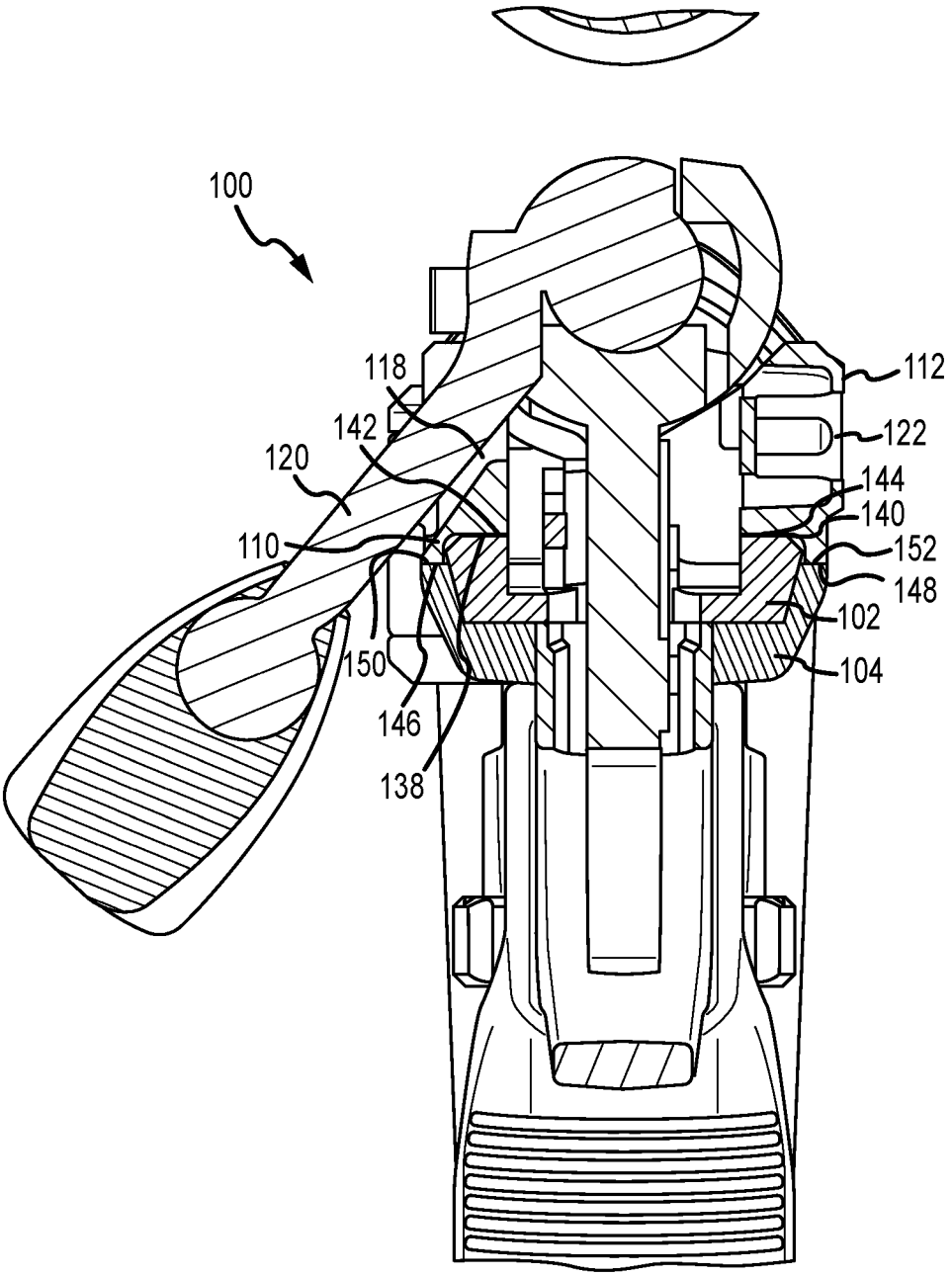
FIG. 5 is a section view illustrating details of components of the firearm in FIG. 1.

As illustrated most clearly in FIG. 5 in combination with FIG. 4, a portion of the first plate 110 may extend through a first recess 124 in the stock portion 104. Similarly, a portion of the second plate 112 may extend through a second recess 126 in the stock portion 104. Relatedly, a portion of the first plate 110 may extend through or into a first recess 128 in the chassis 102. Similarly, a portion of the second plate 112 may extend through or into a second recess 130 in the chassis 102. By having the plates 110, 112 extend into the chassis 102, the Applicant has provided an efficient and suitable means for securing the plates 110, 112, thereby expanding the potential uses of the plates 110, 112. For example, here, the plate 112 not used to receive the bolt handle 120 is configured with a tool interface 122, such as a QD socket 122, which normally would not be possible at the locations 114, 116 illustrated in FIG. 4. Moreover, the locations 114, 116 themselves provide simultaneously provide for the ability to interchange the plates 110, 112 so as to provide for the ability to use a left-hand bolt instead of the right-hand bolt 120 that is shown while also providing an ideal location for a tool interface 122 such as a QD socket 122. Specifically, the locations 114, 116 allow for a single mount sling attachment at a position that ensures the firearm 100 will point down but is also held high enough to maintain an ease of carrying.

As most clearly illustrated in FIG. 1 and FIG. 4, a first fastener 130 may be provided to couple the first plate 110 to the chassis 102, and a second fastener 132 may be provided to couple the second plate 112 to the chassis 102. Additional fasteners 134, 136 may be provided as needed to secure the plates 110, 112 to the chassis 102. The plates 110, 112 may each have one or more fastener receivers 166, such as apertures as illustrated.

As most clearly illustrated in FIG. 5, the first plate 110 and the second plate 112 may each have a flange surface 138, 140, respectively, for engaging respective flange surface 142, 144 on the chassis 102. This feature further improves the strength of the engagement between the plates 110, 112 and the chassis 102.

Relatedly, each of the plates 110, 112 may have a flange surface 146, 148 for engaging a corresponding flange surface 150, 152 on the stock portion 104. Here, the engagement between the flange surfaces 146, 148 in the plates and the flange surfaces 150, 152 in the stock portion 104 may primarily provide for an alignment feature between the plates 110, 112 and stock portion 104. As most clearly illustrated in FIGS. 8, 12, 15, and 19, the plates 110, 112 may have positioning slots 168 to assist in alignment of the plates 110, 112 with the stock portion 104, to improve the ease with which a user may attach the plates 110, 112. That is, the slots 168 may allow a user to generally position the plates 110, 112 and easily hold the plates 110, 112 while attaching using fasteners.

For detailed reference, FIGS. 6-12 illustrate various views of the first plate 110 previously described herein.

For detailed reference, FIGS. 13-19 illustrate various views of the second plate 112 previously described herein.

Figure 20:
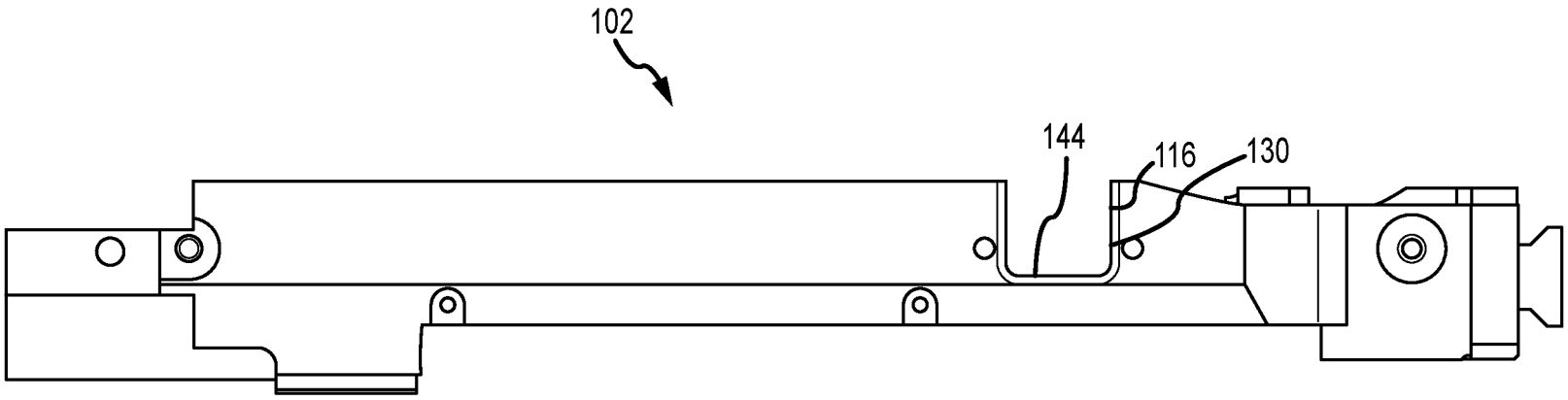
FIG. 20 is a right side view of a chassis used in the firearm in FIG. 1.
Figure 21:
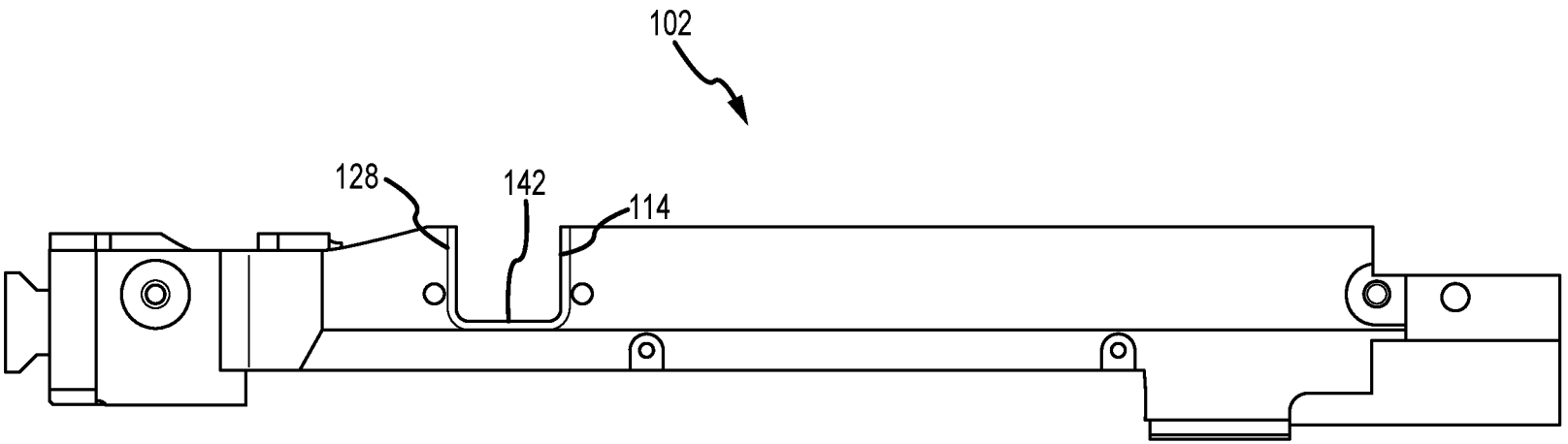
FIG. 21 is a left side view of the chassis in FIG. 20.
Figure 22:
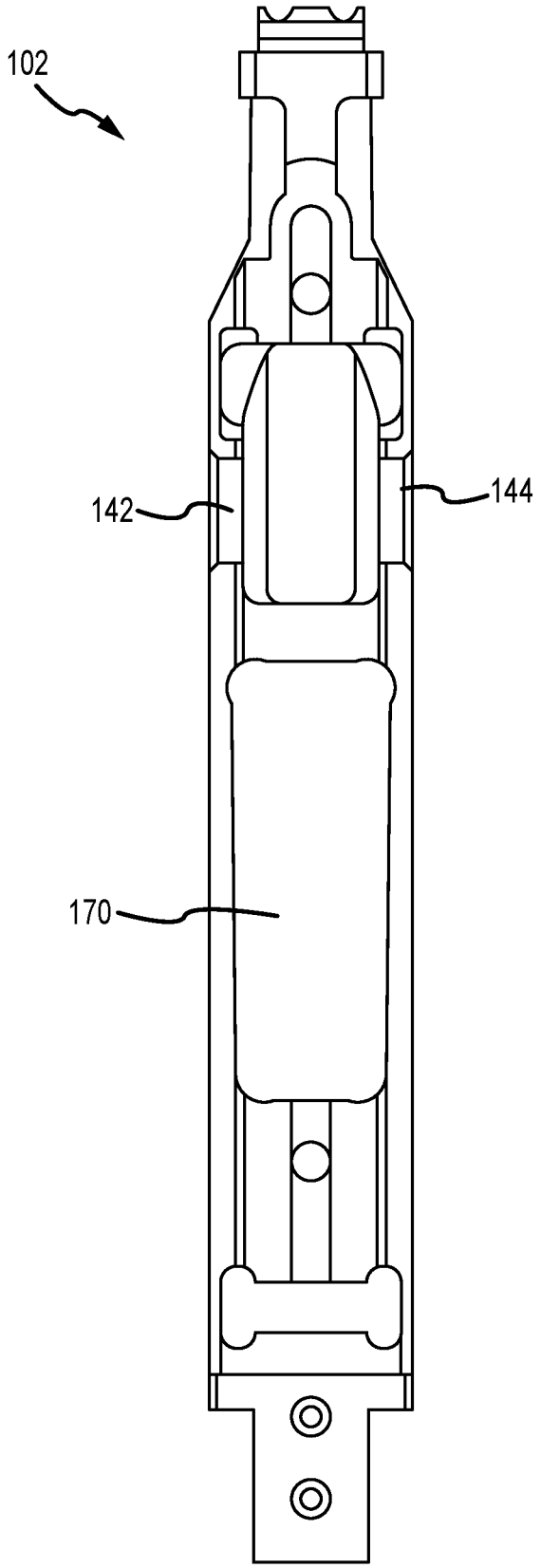
FIG. 22 is a top view of the chassis in FIG. 20.

For detailed reference, FIGS. 20-22 illustrate various views of the chassis 102 previously described herein. As illustrated most clearly in FIG. 22, the chassis 102 may include a magazine well 170.

Figure 23:
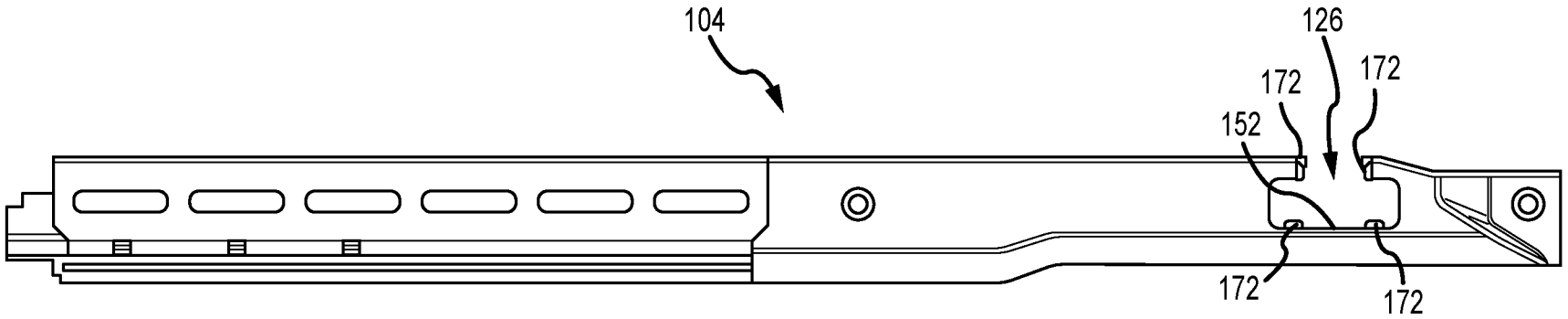
FIG. 23 is a right side view of a stock portion used in the firearm in FIG. 1.
Figure 24:
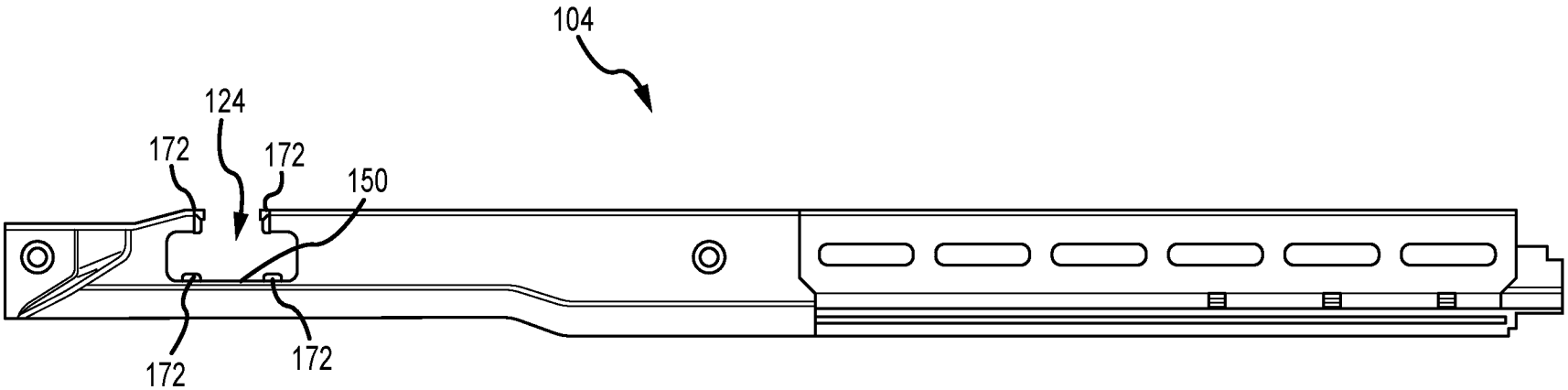
FIG. 24 is a left side view of the stock portion in FIG. 23.
Figure 25:
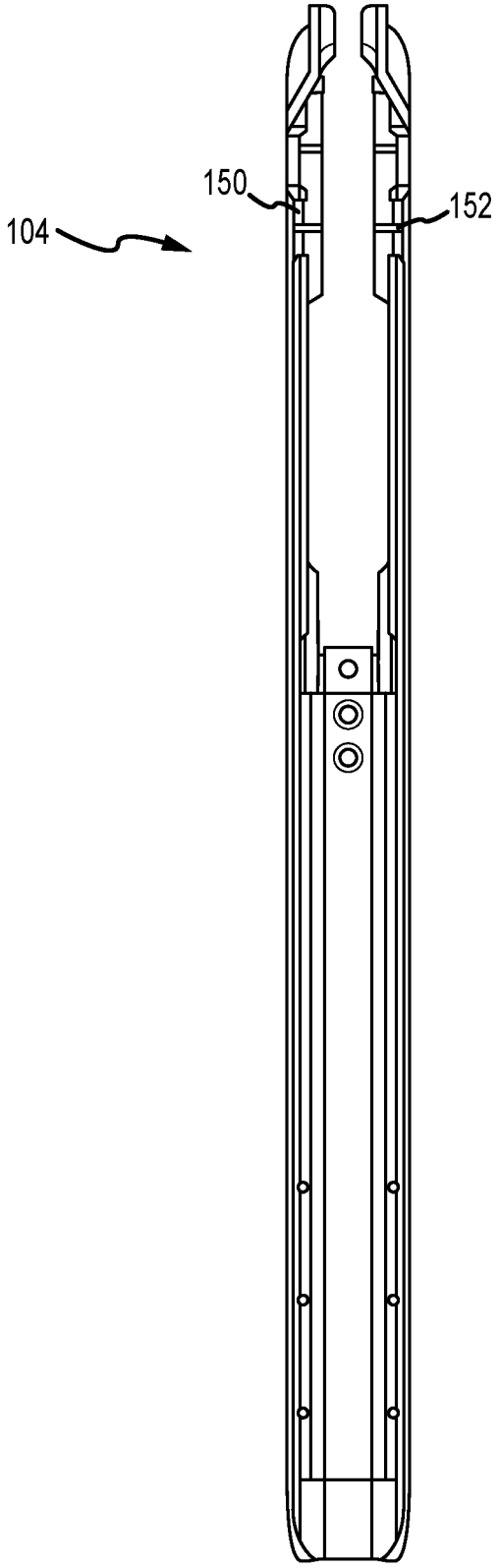
FIG. 25 is a top view of the stock portion in FIG. 23.

For detailed reference, FIGS. 23-25 illustrate various views of the stock portion 104 previously described herein. As illustrated most clearly in FIGS. 23-24, the stock portion 104 may have one or more tabs or protrusions 172 shaped and positioned to engage the slots 168 in the plates 110, 112 for assisting in aligning the plates 110, 112.

Figure 26:
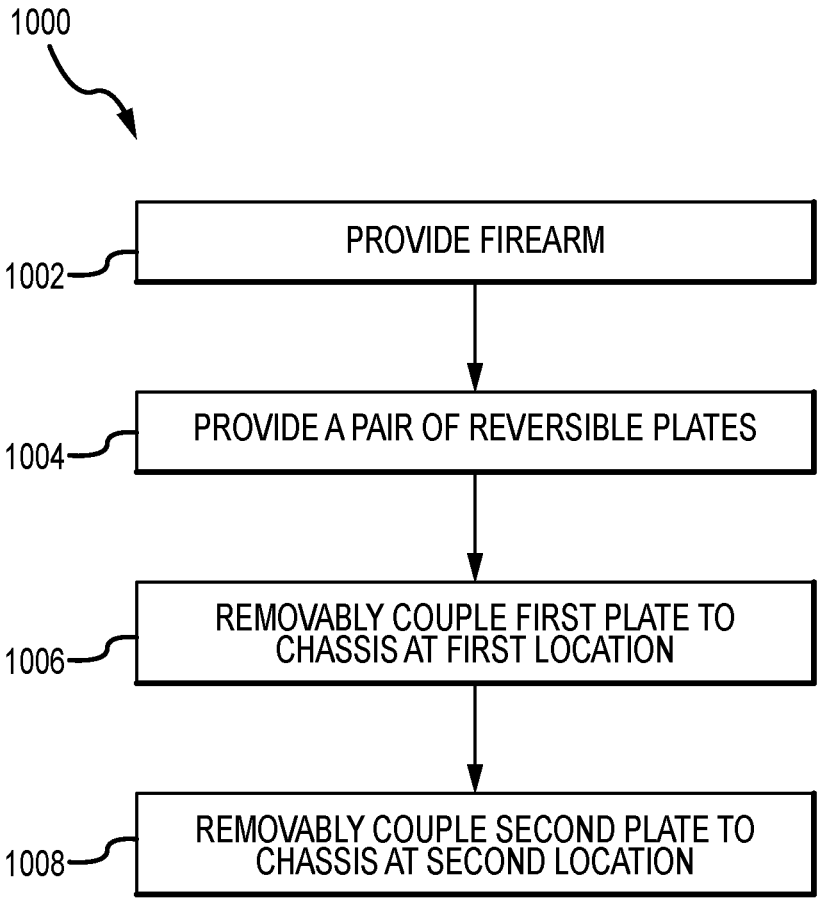
FIG. 26 is a flowchart of a method.

Turning now to FIG. 26, a method 1000 is described. The method 1000 may be performed using the components previously described herein. The method 1000 may include providing 1002 a firearm having bolt handle, a chassis, and a stock portion coupled to the chassis. The method 1000 may include providing 1004 a pair of reversible plates, wherein a first one of the pair of reversible plates has a recess for receiving a portion of the bolt handle, and a second one of the pair of reversible plates has a firearm tool interface. The method 1000 may include removably coupling 1006 the first one of the pair of reversible plates to the chassis at a first location, and/or removably coupling the second one of the pair reversible plates to the chassis at a second location opposing the first location.

The firearm tool interface may be a quick-disconnect socket.

The method 1000 may include passing a portion of the first plate through a first recess in the stock portion, and/or passing a portion of the second plate through a second recess in the stock portion.

The method 1000 may include causing a portion of each of the pair of reversible plates to protrude into respective first and second recesses in the chassis.

The method 1000 may include using a first fastener to couple the first plate to the chassis, and/or using a second fastener to couple the second plate to the chassis.

The method 1000 may include causing a flange surface in each of the plates to engage a respective flange surface on the chassis, whereby the pair of reversible plates are supported by the chassis.

The method 1000 may include causing a flange surface in each of the plates to engage a respective flange surface on the stock portion, whereby the pair of reversible plates are positioned by the stock portion.

The method 1000 may include detaching the reversible plates from the chassis, removably coupling the first plate to the chassis at the second location, removably coupling the second plate to the chassis at the first location.

The method 1000 may include moving a portion of a bolt handle into the recess of the first one of the pair of reversible plates.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. A system comprising:

a first interchangeable plate configured for removable coupling to a chassis of a stock-chassis assembly at a first location and a second location opposing the first location, though not at a same time; wherein the first interchangeable plate comprises an accessory mount;

a portion of the first interchangeable plate is shaped to extend through at least a recess in a stock of the stock-chassis assembly, wherein the stock comprises one or more first tabs or first protrusions shaped and positioned to engage one or more slots in the first interchangeable plate for aligning the first interchangeable plate; and the portion of the first interchangeable plate is shaped to extend through at least a recess in the chassis of the stock-chassis assembly.

2. The system of claim 1, wherein the accessory mount is a quick-disconnect socket.

3. The system of claim 1, wherein the accessory mount is a sling mount.

4. The system of claim 3, wherein the sling mount is located proximal to a center of gravity of the stock-chassis assembly.

5. The system of claim 1, further comprising a second interchangeable plate, a portion of the second interchangeable plate shaped to extend through at least another recess in the stock of the stock-chassis assembly, wherein the stock comprises one or more second tabs or second protrusions shaped and positioned to engage one or more slots in the second interchangeable plate for aligning the second interchangeable plate.

6. The system of claim 5, wherein the portion of the second interchangeable plate is shaped to extend through at least another recess in the chassis of the stock-chassis assembly.

7. The system of claim 5, wherein the second interchangeable plate has a plate recess configured for receiving a portion of a bolt handle of the stock-chassis assembly.

8. The system of claim 5, wherein each of the first interchangeable plate and the second interchangeable plate include at least one fastener receiver shaped to accept a respective fastener, each of the fasteners configure to couple the interchangeable plates to the chassis.

9. The system of claim 1, wherein the stock-chassis assembly is one or more of a firearm and a rifle.

10. The system of claim 1, wherein the stock-chassis assembly is one or more of a weapon and a gun firing a projectile.

11. The system of claim 5, wherein the one or more first tabs or protrusions and the one or more second tabs or protrusions are arranged in opposing locations on the stock of the stock-chassis assembly.

12. A stock-chassis assembly comprising:

a chassis having a first recess and a second recess arranged in opposing locations;

a barrel coupled to the chassis;

a bolt handle coupled to the chassis;

a stock coupled to the chassis and having a third and a fourth recess arranged in opposing locations and aligned with the first and second recesses, and wherein the stock comprises one or more first tabs or first protrusions arranged near the third recess and one or more second tabs or protrusions arranged near the fourth recess; and a first interchangeable plate configured for removable coupling to the chassis at a first location and a second location opposing the first location, though not at a same time, and wherein the first interchangeable plate comprises one or more slots; wherein the first interchangeable plate comprises an accessory mount;

a portion of the first interchangeable plate is shaped to extend through at least the first and third recesses, and wherein the one or more first tabs or protrusions in the stock are shaped and positioned to engage the one or more slots in the first interchangeable plate for aligning the first interchangeable plate.

13. The stock-chassis assembly of claim 12, wherein the third and fourth recesses are wider than the first and second recesses.

14. The stock-chassis assembly of claim 12, wherein the accessory mount is a quick-disconnect socket.

15. The stock-chassis assembly of claim 12, wherein the accessory mount is a sling mount.

16. The stock-chassis assembly of claim 15, wherein the sling mount is located proximal to a center of gravity of the stock-chassis assembly.

17. The stock-chassis assembly of claim 12, further comprising a second interchangeable plate, the second interchangeable plate comprising one or more slots, wherein a portion of the second interchangeable plate is shaped to extend through at least the second and fourth recesses, and wherein the one or more second tabs or protrusions in the stock are shaped and positioned to engage the one or more slots in the second interchangeable plate for aligning the second interchangeable plate.

18. The stock-chassis assembly of claim 17, wherein the second interchangeable plate has a plate recess configured for receiving a portion of a bolt handle of the stock-chassis assembly.

19. The stock-chassis assembly of claim 17, wherein each of the first interchangeable plate and the second interchangeable plate include at least one fastener receiver shaped to accept a respective fastener, each of the fasteners configured to couple the interchangeable plates to the chassis.

20. The stock-chassis assembly of claim 17, wherein the one or more first tabs or protrusions and the one or more second tabs or protrusions are arranged in opposing locations on the stock.

* * * * *